US005299433A

United States Patent [19]

Harms et al.

[11] Patent Number: 5,299,433

[45] Date of Patent: Apr. 5, 1994

[54] PITCHER HAVING MEANS FOR KEEPING BEVERAGE COLD

[76] Inventors: Jerry E. Harms, 280 Langford Dr., Chuluota, Fla. 32766; Thomas C. Harms, Sr., 6 Oak Tree Dr.; Thomas C. Harms, Jr., 22935 Somerset Dr., both of Sorrento, Fla. 32776

[21] Appl. No.: 5,241

[22] Filed: Jan. 15, 1993

[51] Int. Cl.[5] ..... F25D 3/08

[52] U.S. Cl. ..... 62/457.2; 62/457.8; 62/530

[58] Field of Search ..... 62/457.1, 457.2, 457.4, 62/457.8, 371, 372, 530, 529

[56] References Cited

U.S. PATENT DOCUMENTS 93,001 7/1869 Pietsch .
1,771,186 7/1930 Mock .
2,030,005 2/1936 Kellogg .
2,526,165 10/1950 Smith .
3,413,820 12/1968 Paquin .
4,691,664 9/1987 Crowell .

*Primary Examiner*—John M. Sollecito
*Attorney, Agent, or Firm*—Julian C. Renfro

[57] ABSTRACT

A beverage container utilizing a cooling device for keeping a beverage cold over a protracted period of time, with such container having sidewalls and a bottom defining a volume in which a beverage can be contained. The cooling device is operatively associated with a lower interior portion of the container and involves a closed receptacle of a refreezable, non toxic substance. When the cooling device has become relatively warm, it is readily removable from contact with the lower interior portion of the container, so that it may be replaced by a freshly-chilled cooling device of like configuration, thus to keep the beverage at a desirably low temperature. We provide several different types of magnetic and mechanical devices for preventing the cooling device from being displaced when the pitcher is tilted to pour out some or all of its contents.

5 Claims, 3 Drawing Sheets

PITCHER HAVING MEANS FOR KEEPING BEVERAGE COLD

BACKGROUND OF THE INVENTION

It has long been known to be desirable to keep a beverage contained in a pitcher cool, without diluting such beverage by the addition of ice. Although the addition of ice to a beverage such as ice tea may be satisfactory, the addition of ice to a beverage such as beer would usually be highly undesirable.

The 1869 patent to Pietsch, U.S. Pat. No. 93,001 entitled "Pitcher" is seen to represent an effort to keep the contents of a pitcher cool by providing an ice chamber J in which chunks of ice may be maintained. Although this arrangement is generally functional, it involves a considerable part of the interior of the pitcher being utilized for containing the ice, with the result that the volume available in the pitcher for the beverage is relatively small.

The Mock U.S. Pat. No. 1,771,186 entitled "Serving Element for Electric Refrigerators" was an improvement over Pietsch in that it involved the use of a serving element having double walls, with the space between the walls being partially but not completely filled with water. This patentee envisions his serving element placed upside down in an electric refrigerator, for example, such that ice forms in the space between the walls. As a consequence of this arrangement, when a beverage is thereafter poured into the space defined by the inner chamber, the ice between the walls commences to melt and to chill the beverage. This arrangement is only good for one serving of beverage, with the serving container having to be cycled through another cooling process in a refrigerator before it would be suitable for chilling another container of beverage.

The Kellogg U.S. Pat. No. 2,030,005 entitled "Container and Cooling Means Therefor" teaches the use of a type of keg or barrel utilized for beer or other malt beverages, with an arrangement utilized such that the contents of the keg or barrel are kept at a low temperature.

The keg or barrel has inner and outer walls held in spaced relation by tubes 15, which serve both as a refrigerating as well as a spacing means. Carbon dioxide is utilized as a gaseous refrigerant. It is obvious that the Kellogg teaching would not be pertinent to the cooling of a pitcher, such as a pitcher utilized for containing beer, but rather would be limited to a comparatively large scale cooling arrangement.

Other patentees such as the Smith U.S. Pat. No. 2,526,165, the Paquin U.S. Pat. No. 3,413,820 and the Crowell U.S. Pat. No. 4,691,664 have taught the use of placing cooling means in a receptacle, but in none of these instances was the arrangement such that a pitcher of beer, for example, could be maintained at a desirably low temperature.

It was in an effort to overcome the limitations of these and other such devices that the present invention was designed.

SUMMARY OF THE INVENTION

In accordance with this invention, we have provided a pitcher, beverage container, or like receptacle containing cooling means and particularly designed for containing a beverage that is to be drunk at a temperature substantially below room temperature.

Our new pitcher or beverage container has sidewalls and a bottom, with the sidewalls and bottom together defining an enclosed space in which a beverage can be contained. A cooling device or cooling means in the form of a closed container means is operatively associated with the bottom, with this closed container means adapted to contain a chilled substance, so that the temperature of a beverage contained in the pitcher will be caused to be reduced upon coming in contact with the closed container means. So that the same pitcher can be used over a protracted period of time, the closed container means is removably attached adjacent the lower interior portion of the pitcher, so that when one cooling means is no longer effective, it can be readily removed and replaced by a freshly chilled one.

It is of course well known that non-toxic, refreezable products variously known as "Freezy Cold," "Freezer Pack," "Magic Cold," "Wizard Dri-Cube" and the like have been on the market for many years, which provide a cooling effect without any dilution of a beverage taking place. However, when the contents of the typical Freezy Cold or Freezer Pack have come up to approximately room temperature, it then becomes desirable to exchange one chilling device for another one. If an entire beverage container or pitcher needs to be refrigerated in order to bring the Freezy Cold or Freezer Pack back to a temperature suitable for chilling the contents of the container, this will cause an obvious disruption of the drinking cycle, and a needless introduction of another pitcher for containing the next round of beverage. It was to overcome such a situation that the present invention was evolved.

Others have proposed the insertion of a cooling device into a container for a beverage, but in almost known instances, the container needs to be inverted for the installation of the cooling device, which of course would cause spillage in the event some beverage remains in the bottom of the container. Also, some other arrangements often involve the user having to place his or her hand inside the container, thereby offending some drinkers, who do not wish to see unwashed hands come in contact with beverages they are about to imbibe.

In accordance with this invention we have utilized a refrigerated cooling device held in place in a removable manner adjacent the bottom of a pitcher. Several of the embodiments of our invention involve a cooling device held in operative location by the use of magnetic means. By virtue of this arrangement, at such time as a cooling means or cooling device has come up to room temperature, it can be readily exchanged for a cooling device that has just been removed from a refrigerating source. Because the freshly-refrigerated cooling device has been constructed so as to encapsulate and contain either a magnetic device or a ferric metal plate, the freshly-refrigerated cooling device can be readily inserted in the operative position without necessitating that the container be inverted, or that the contents of the pitcher or other such container be emptied. As is obvious, the use of the magnetic means prevents the cooling device from moving out of a desired position in the bottom of the pitcher at such time as the pitcher is tilted to pour out some or all of its contents.

Other embodiments of our invention involve the cooling device held in the operative position adjacent the bottom of the pitcher by means latching to the handle of the pitcher, or by the use of mechanical means attached to the bottom of the pitcher, to which the bottom of the cooling device or capsule can be removably yet tightly attached.

It is therefore a primary object of our invention to provide a pitcher having a closed container removably disposed in the interior of the pitcher, in which container a refreezable cooling means is disposed, that serves to keep the beverage in the pitcher at a desirably low temperature.

It is another object of our invention to provide a pitcher having a bottom adjacent which a cooling device filled with refreezable coolant may be removably attached, with the arrangement being such that a cooling device whose temperature is no longer effective for maintaining the beverage in a cooled condition can be readily replaced with a like device that has been freshly chilled.

It is still another object to provide a pitcher that can be manufactured at a relatively low cost, that is able to utilize a variety of different refreezable cooling devices any of which may be readily replaced when the cooling effect thereof has substantially diminished.

These and other objects, features and advantages will be more apparent from a study of the enclosed drawings.

DETAILED DESCRIPTION

Figure 1:
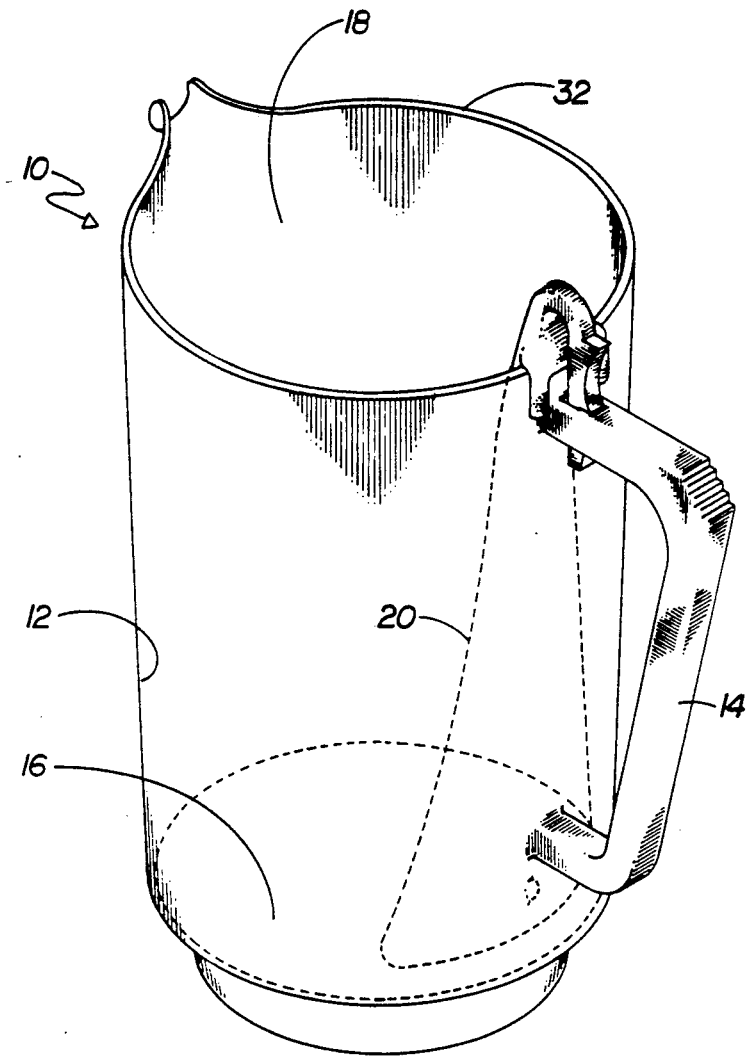
FIG. 1 is a perspective view of a pitcher equipped with one embodiment of a readily replaceable closed container means disposed near the bottom of the pitcher, which container means is adapted to contain a chilled refreezable substance.

In FIG. 1 it will be noted that we have illustrated a beverage container in the form of a pitcher 10 adapted to contain a beverage, and utilizing means to keep the beverage cold over a protracted period of time. The pitcher 10 has sidewalls 12, a handle 14, and a bottom 16, with the sidewalls and the bottom together defining an enclosed space or volume 18 in which a beverage can be contained.

In accordance with the embodiment of the invention depicted in FIG. 1, we provide a closed container means or cooling device 20 in the interior of the pitcher, the volume of which means is relatively small when compared with the volume of the pitcher. The means 20 in FIG. 1 is relatively small at the top, gradually enlarging toward the bottom, and designed to hold a chilled, refreezable substance in a non-leak manner. In other words, the device 20 is a sealed container of a non-toxic, refreezable substance variously known as "Freezy Cold," "Freezer Pack," "Magic Cold," "Wizard Dri-Cube" and the like have been on the market for many years, which provide a cooling effect without the beverage in which it is placed being diluted. The device 20 is preferably made of plastic, and of a size such that it can be easily refrigerated, and when frozen, readily installed in the interior of the pitcher to bring about the chilling of the contents thereof.

Figure 2:
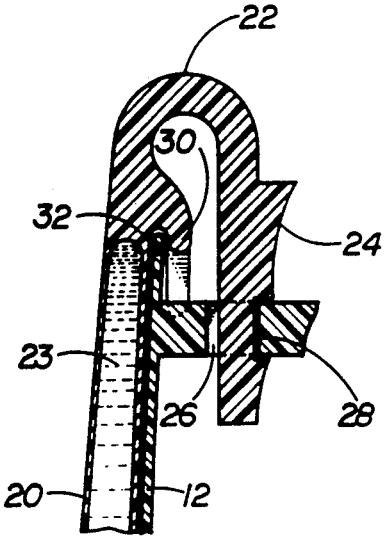
FIG. 2 is a fragmentary view of an upper portion of the pitcher of FIG. 1 in which are revealed certain details of a preferred form of latching mechanism for holding the closed container means in an operative position adjacent the bottom of the pitcher.

In FIG. 2, we show an arrangement responsible for holding the device 20 against the interior sidewall of the pitcher, even when the pitcher is tilted for the purpose of pouring out some or all of the contents thereof, such as into a glass, cup or mug.

It will be noted in FIG. 2 that the uppermost end 22 of the device 20 has substantial curvature in that it evolves upwardly from the liquid-containing portion 23, then turns approximately 180 degrees in order to form a downwardly descending portion 24 that is configured to interact with a slot or aperture 26 that is formed in the upper end of the handle 14. It will be noted in FIG. 2 that the slot or aperture 26 is disposed in the handle at a location closely adjacent the sidewall of the pitcher.

The uppermost end 22 is of springy, resilient construction such that the downwardly descending portion 24 would normally stand away from the pitcher sidewall if it were not restrained. The configuration and construction of the portion 24 permits it to be pushed or squeezed inwardly so that it can be caused to enter the slot or aperture 26 int he handle at the time the enlarged lower portion of the device 20 is being inserted into the pitcher. As will be readily understood, this squeezing action causes the storage of potential energy in the portion 22. A notch 28 is formed in an outer portion of the descending portion 24, which notch is designed to engage the handle portion at the location of the slot or aperture 26. As a result of the storage of energy in the portion 22, the notch 28 engages the handle with a rather substantial amount of force, thus preventing the enlarged lower portion of the sealed cooling device moving away from the inner sidewall of the pitcher, even when the pitcher is tilted.

In addition, we utilize a lip or sidewall-engaging member 30 on an upper part of the device 20, which lip or sidewall-engaging member 30 may be regarded as being located in an interior part of the highly curved upper portion 22. The lip or sidewall-engaging member 30 is hook-shaped, such that it engages and rests against an outer part of the upper edge or rim 32 of the pitcher sidewall 12. This arrangement is such that the cooling means 20 is held in a desirable relationship to the pitcher 10, for the hook-shaped member 30 serves a function in the nature of a fulcrum. In other words, the outward force of the curved upper portion 22 against the handle at the location of the notch 28 is such as to force the lower part of the cooling means 20 against the inner sidewall of the pitcher.

As a result of this construction, the cooling device 20 remains flat against the inner sidewall of the pitcher at all times, even when the pitcher is tilted to pour out some or all of the contents. The volume of the cooling means 20 represents at least one-sixth of the total volume of the pitcher, but depending upon the particular beverage or other circumstances, the volume of the freezer pack or "freezy cold," could be as high as one-third of the volume of the beverage container.

Figure 3:
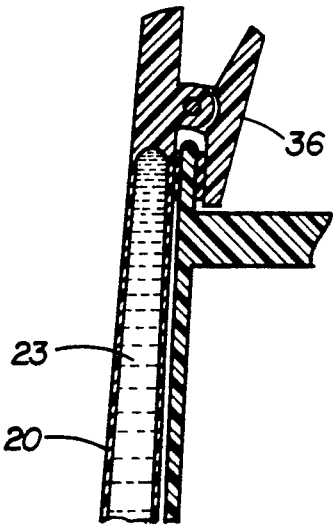
FIG. 3 is a fragmentary view similar to FIG. 2 that reveals another means of latching the closed container means in an operative position in the pitcher.

With reference to FIG. 3, we show an alternative construction in which a clip member 36 is utilized at the upper end of the closed container means or sealed cooling device 20, to hold the device in the desired relationship to the inner sidewall of the pitcher.

So that a single pitcher can be used over a period of several hours, we arrange, in accordance with this invention, for a closed container or refrigerated cooling device that has become ineffective for further chilling the beverage, to be readily exchanged for a freshly chilled device of like kind and configuration. As will be seen at greater length hereinafter, the sealed container means or removable chilling device can take several different forms.

Figure 4:
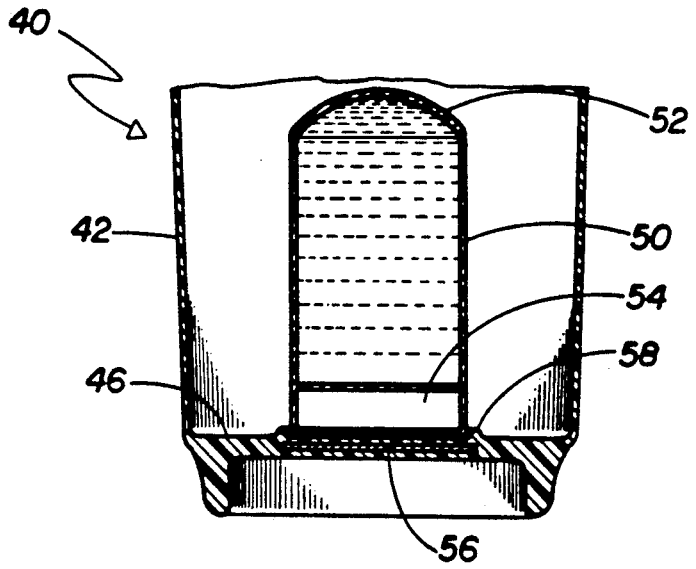
FIG. 4 is a fragmentary view of a first embodiment involving the use of magnetic means for retaining a closed container of chilled, refreezable substance in the bottom of a pitcher, with the magnet in this instance located in the bottom of the closed container.

With regard to FIG. 4, it is to be seen that we have shown the lower portion of a pitcher 40 having sidewalls 42, and a bottom 46 in which a closed container means 50 is removably disposed. The closed container means 50 takes the form of an upwardly extending, generally cylindrically-shaped protrusion or capsule serving as a cooling device. The upwardly-extending cylindrically shaped container means 50 is essentially hollow and is adapted to contain a non-toxic refreezable substance such as "Freezy-Cold," "Freezer Pack," "Magic Cold," "Wizard Dri-Cube" and the like. As previously mentioned, a product of this type is commercially-available, and may be frozen and thawed a large number of times while still maintaining its effectivity. The container means preferably has a domed upper portion 52 and sidewalls that are comparatively thin, so as to make a rapid transfer of heat out of the beverage readily possible.

As a result of the utilization of a non-toxic, refreezable solution in the sealed container means or cooling means 50, the temperature of a beverage contained in the pitcher will be substantially reduced upon coming in contact with the outer sidewalls of the closed container means or cooling device 50. The volume of the cooling means 50 represents at least one-sixth of the total volume of the beverage container, but depending upon the particular beverage or other circumstances, the volume of the refreezable, non-toxic substance we use could be as high as approximately one-third of the volume of the beverage container.

With continued reference to FIG. 4, it is to be understood that in accordance with a preferred embodiment, the container means or cooling device 50 is designed to utilize a magnet 54 molded into the lowermost portion of its bottom. The magnet 54 is encapsulated in a position in which it is entirely out of contact with either the non-toxic chilling substance, or the contents of the pitcher, but only a very thin layer of plastic is disposed on the lower side of the magnet.

Molded in the center of the bottom 46 of the pitcher 40 is a ferric metal disc or plate 56. The disc 56, which may be steel or the like, is encapsulated in a position in which it is entirely out of contact with the contents of the pitcher, and only a thin layer of plastic isolates the disk from the magnet when the two are brought into the relationship depicted in FIG. 4.

Because of the thinness of the plastic separating the magnet from the steel disk, the holding power of the magnet 54 is not markedly diminished.

So that the cooling device or capsule 50 will not shift from side to side in the pitcher, we prefer to establish a central recess in the bottom of the pitcher, principally defined by a molded, slightly raised shoulder or ridge 58 located in the central portion of the pitcher bottom 46. The creation of this central recess enables the person or persons utilizing the pitcher to readily ascertain the location where the cooling device or capsule 50 is to be received. The magnetic force of the magnet 54 is concentrated at the location of the recess defined by the ridge 58.

Figure 5:
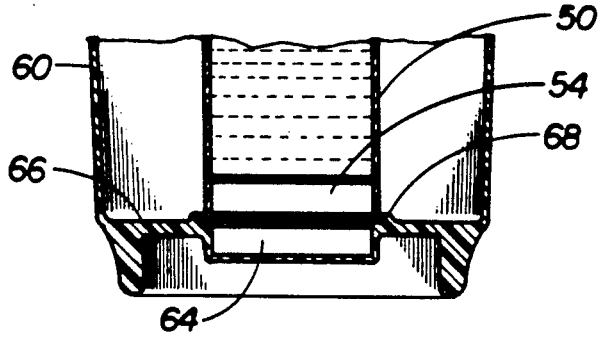
FIG. 5 is a fragmentary view of a second embodiment in which magnetic means are utilized for retaining a closed container of chilled refreezable substance in the bottom of a pitcher, with a magnet of one polarity located in the closed container, and a magnet of opposite polarity located in the pitcher.

As another option, and with reference to FIG. 5, we reveal an embodiment in which a magnet 54 is used in the bottom of the cooling device 50, and a second magnet 64 is used in the bottom 66 of the pitcher 60. A shoulder or ridge 68 is disposed around the central portion of the bottom 66 of the pitcher, defining the recess in which the cooling device 50 may be received. Inasmuch as unlike poles of magnets attract, the polarity of magnet 54 is opposite to the polarity of magnet 64. The pair of magnets create a substantial force holding the cooling device 50 in the bottom of the pitcher 60.

Figure 6:
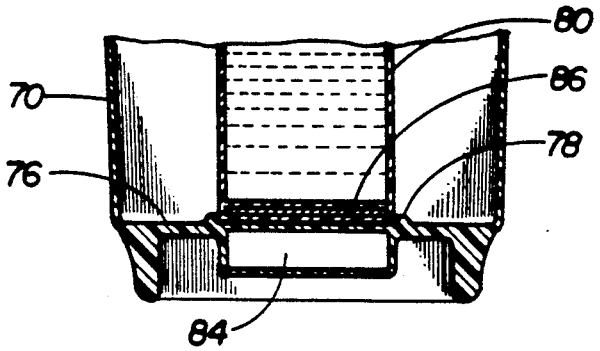
FIG. 6 is a fragmentary view of a third embodiment in which magnetic means are utilized for retaining a closed container of chilled refreezable substance in the bottom of a pitcher, with the magnet in this instance located in the bottom of the pitcher.

In FIG. 6, we reveal a pitcher 70 having a bottom 76 in which is disposed a magnet 84. Used in this embodiment is a shoulder or ridge 78 defining a recess in which the bottom of the sealed cooling device 80 can be readily received. A steel disk 86 is molded in the bottom of the cooling device 80, with the magnet 84 causing the device 80 to be held tightly in the bottom of the pitcher. As in the other magnetic embodiments, the interaction between the magnet 84 and the ferric metal disk 86 is such as to prevent displacement of the cooling means 80 when the pitcher is tilted.

Figure 7:
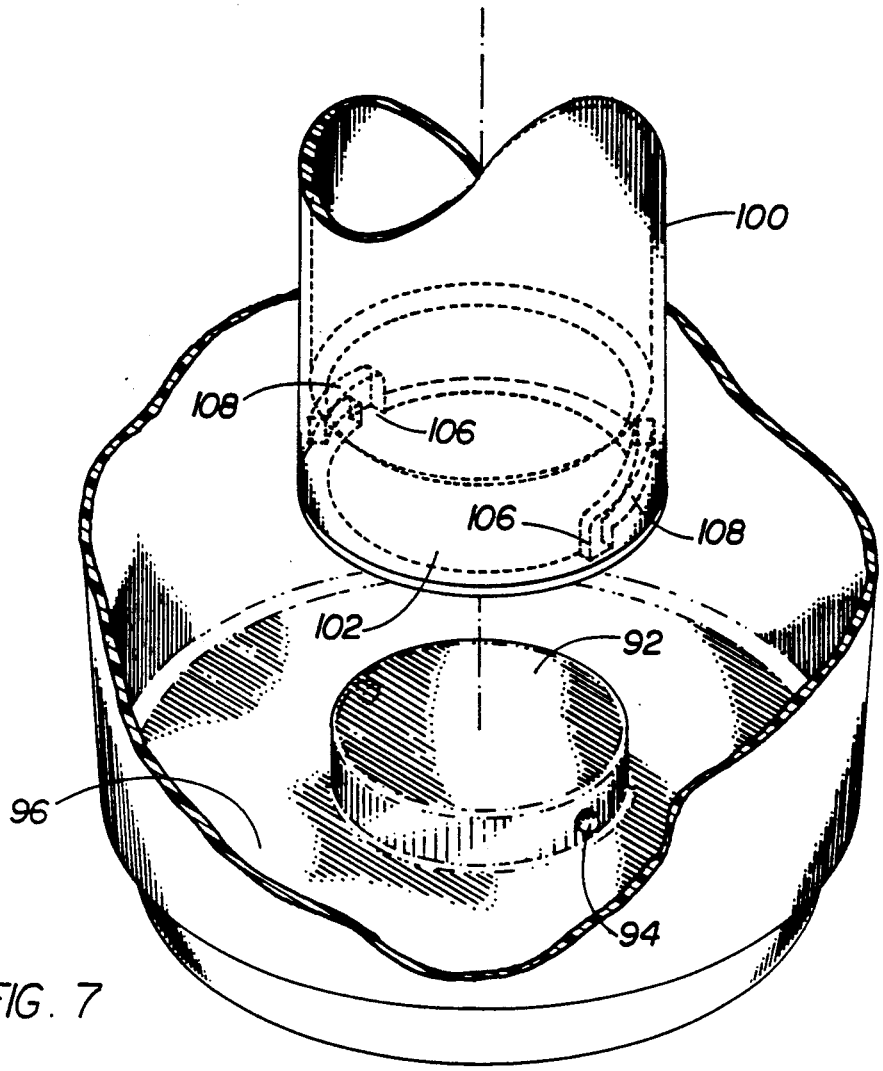
FIG. 7 is a fragmentary view of an embodiment in which mechanical means are utilized for holding the closed container of refreezable substance in the bottom of the pitcher.
Figure 8:
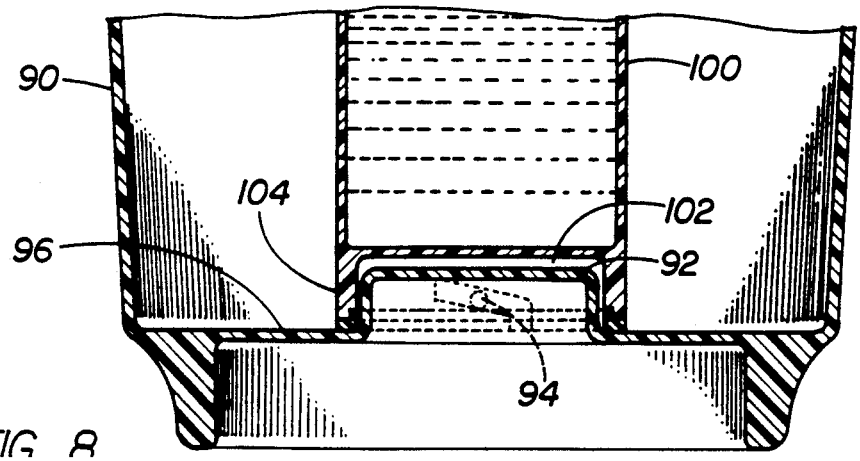
FIG. 8 is a cross-sectional view, revealing more details of the mechanical arrangement of FIG. 7.

Now with reference to related FIGS. 7 and 8, it will there be seen that we have shown a fragmentary portion of a pitcher 90, in the central portion of the bottom 96 of which is located an upstanding boss or mounting member 92. The boss or mounting member 92 is circular, having a pair of protruding members 94 disposed on diametrically opposite portions of the mounting member 92. The cooling device 100 is a sealed container of a non-toxic, refreezable substance variously known as "Freezy Cold," "Freezer Pack," "Magic Cold," "Wizard Dri-Cube" and the like, which provides a cooling effect without the beverage in which it is placed being diluted. The device 100 is preferably made of plastic, and of a size such that it can be easily refrigerated, and when frozen, readily installed in the interior of the pitcher 90, to bring about the chilling of the contents thereof.

The cooling device 100 is held in place in the bottom of the pitcher 90 by mechanical means rather than magnetic means. So that the device 100 can be readily attached to the upstanding boss or mounting member 92, we provide a recess 102 on the underside of the device 100 that is large enough to fit rather closely around the upstanding boss 92. The recess 102 is defined by an integral encircling skirt or rim 104 extending continuously around the bottom of the cooling device or capsule 100. So that the skirt or rim 104 can be removably attached to the boss or mounting member 92, we provide vertically disposed slots 106 at oppositely disposed locations on the skirt or rim 104. The slots 106 are sized to permit entry of the protruding members 94 as the lower portion of device 100 is placed over the upstanding boss 92.

The upper end of each of the vertically disposed slots 106 is connected to a respective angularly disposed slot 108. This arrangement is such as to permit entry of the protruding members 94 into the angled slots 108 at such time as the sealed cooling means 100 is twisted. We prefer for the relationship of these components to be such that by the time the protruding members 94 have traveled approximately one-half of the length of the angled slots 108, the bottom of the skirt or rim 104 is in firm contact with the bottom 96 of the pitcher, as is apparent from FIG. 8.

As should now be clear, we have provided a pitcher adapted to keep a beverage cold for a protracted length of time by the use of a sealed cooling means containing a refreezable substance, which cooling means can be readily installed adjacent the bottom of the pitcher. Quite advantageously, our sealed cooling means, when it becomes relatively warm, can be readily replaced by a freshly-chilled cooling means, thus to enable the beverage to remain chilled while using the same pitcher. In this way, it is unnecessary to dilute the contents of the pitcher, as would have taken place had ice been used.

The undesired displacement of our sealed cooling means is obviated by the use of either magnetic or mechanical means, thus preventing the cooling means from falling out of the pitcher when it is tilted to pour out some or all of its contents. The volume of the sealed cooling means can in each instance range between one-sixth to one-third of the volume of the pitcher or other beverage container.

We obviously are not to be limited to the particular embodiments described herein, except as required by the scope of the appended claims.

We claim:

1. A beverage container having means for keeping a beverage cold over a protracted period of time, said container having sidewalls and a bottom, said sidewalls and said bottom defining a volume in which a beverage can be contained, cooling means operatively associated with a lower interior portion of said container, said cooling means involving a closed receptacle of a refreezable, non-toxic substance, said cooling means, when it has become relatively warm, being readily removable from contact with said lower interior portion of the container, so that it may be replaced by a freshly chilled cooling means, said cooling means having an upper portion with which a spring latch means is operatively associated, said spring latch means serving to normally hold said cooling means relatively close to the inner sidewall of said beverage container, even when said container has been tipped, whereby a beverage placed in said container and coming into contact with said cooling means can be chilled over a protracted length of time.

2. The beverage container having mans for keeping a beverage cold as recited in claim 1 in which said cooling means has a hook-shaped portion in direct contact with the upper sidewalls of said container, for assisting said spring latch means in holding said cooling means, closely adjacent the inner sidewall of said beverage container.

3. The beverage container having means for keeping a beverage cold as recited in claim 1 in which said container is equipped with a handle, and said cooling means is supported from a location on the upper sidewalls of the beverage container, said spring latch means interacting with an upper portion of said handle, thus enabling said upper portion of said cooling means to be placed in a latching relationship with said handle, from which it can be readily removed.

4. In a pitcher having means for keeping a beverage cold over a protracted period of time, said pitcher having a handle as well as sidewalls and a bottom, said sidewalls and said bottom defining a volume in which a beverage can be contained, cooling means operatively associated with a lower interior portion of the pitcher, said cooling means involving a sealed container of a refreezable, non-toxic substance, said cooling means having an uppermost end of springy, resilient construction, and said handle having an aperture in its upper portion, said uppermost end of said cooling means having a component operatively interacting with said handle, and interfitting with said aperture located in said handle, a user, by thumb pressure, being able to cause said uppermost end of said cooling means to move away from contact with said handle when said cooling means has become relatively warm, such that said cooling means can be readily removed from contact with said lower interior portion of said pitcher, so that it may be replaced by a freshly chilled cooling means, such that a beverage placed in the pitcher and coming into contact with said cooling means can be chilled over a protracted length of time.

5. A pitcher having means for keeping a beverage cold over a protracted period of time, said pitcher having a handle, sidewalls and a bottom, said sidewalls and said bottom defining a volume in which a beverage can be contained, cooling means operatively associated with a lower interior portion of the pitcher, said cooling means involving a sealed container of a refreezable, non-toxic substance, said cooling means having an uppermost end of springy, resilient construction, forming a partial loop with a notch therein, said handle having an aperture into which said notch can extend and engage said handle at such time as said cooling means is inserted into said pitcher, the user of said pitcher, by an appropriate amount of thumb pressure, being able to overcome the spring force inherent in said uppermost end because of its springy, resilient construction, such pressure causing said notch to move away from handle contact, so as to enable said cooling means to be separated from said handle at such time as said cooling means has become relatively warm, so that latter cooling means may be replaced by a freshly chilled cooling means, thus to keep the beverage in the pitcher chilled over a protracted length of time.

* * * * *